US006533477B2

(12) United States Patent
Fukuda

(10) Patent No.: US 6,533,477 B2
(45) Date of Patent: Mar. 18, 2003

(54) THERMAL LINE PRINTER AND PRINTING METHOD THEREFOR

(75) Inventor: Hiroshi Fukuda, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 45 days.

(21) Appl. No.: 09/775,625

(22) Filed: Feb. 5, 2001

(65) Prior Publication Data

US 2001/0012463 A1 Aug. 9, 2001

(30) Foreign Application Priority Data

Feb. 3, 2000 (JP) ..... 2000-025970

(51) Int. Cl.[7] ..... B41J 2/315

(52) U.S. Cl. ..... 400/120.01; 400/120.11; 400/62; 400/73; 347/23; 347/188; 347/191; 347/195

(58) Field of Search ..... 400/120.01, 120.09, 400/120.1, 120.03, 120.11, 62, 73; 347/42, 43, 23, 175, 188, 190, 191, 194, 195, 26

(56) References Cited

U.S. PATENT DOCUMENTS 5,066,961 A * 11/1991 Yamashita ..... 347/76
5,349,373 A * 9/1994 Matsumoto et al. ..... 347/172
5,444,468 A * 8/1995 Fukushima et al. ..... 347/14
5,625,394 A * 4/1997 Fukuda et al. ..... 347/175
5,800,075 A * 9/1998 Katsuma et al. ..... 400/120.14
5,934,811 A * 8/1999 Miyaji ..... 400/120.07
6,047,092 A * 4/2000 Moro ..... 382/261
6,313,924 B2 * 11/2001 Kanamori ..... 358/1.9

* cited by examiner

*Primary Examiner*—Andrew H. Hirshfeld
*Assistant Examiner*—Darius N. Cone
(74) *Attorney, Agent, or Firm*—Sughrue Mion, PLLC

(57) ABSTRACT

There is disclosed a thermosensitive line printer, wherein a heating element array of a thermal head is pressed on a thermosensitive recording paper at a distance L2 from a nipping position by a pair of conveyer rollers, and is driven to record an image frame line by line from a print starting end, as the recording paper is conveyed by the conveyer rollers in a direction from the thermal head to the conveyer rollers. Based on image data of an upper zone of an image frame that is to be recorded around the distance L2 from the print starting end if the image frame is recorded from its top side, an image analyzer calculates a first estimation value that represents conspicuousness of potential density deviation in the upper zone that could be caused by a thermal deformation of the thermosensitive recording paper at the print starting end if the image frame is recorded from the top side. The image analyzer calculates a second estimation value based on image data of a lower zone that is to be located at the distance L2 from the print starting end if the image frame is recorded from its bottom side. If the first estimation value is smaller than the second estimation value, the image frame is recorded from the top side, and vise versa.

14 Claims, 11 Drawing Sheets

UPPER ZONE

LOWER ZONE

UPPER ZONE

LOWER ZONE

THERMAL LINE PRINTER AND PRINTING METHOD THEREFOR

BACKGROUND OF THE INVENTION

1. Field of the Invention

The present invention relates to a thermal line printer that prints an image on recording paper in a line sequential fashion, and more particularly to a thermal line printer that reduces unexpected density variations of the printed image caused by thermal deformations of the recording paper.

2. Background Arts

In a color thermosensitive line printer, a thermosensitive color recording paper having thermosensitive coloring layers for yellow, magenta and cyan is heated by a thermal head while being moved relative to the thermal head, to print a full-color image in a three-color frame sequential fashion.

As shown for instance in FIG. 12, a thermosensitive color recording paper 43 is moved past a thermal head 44 by conveyer roller pairs 42, each pair consisting of a capstan roller 40 and a nip roller 41. The thermal head 44 has a heating element array 46 consisting of a large number of heating elements 45 aligned along a main scan direction that is perpendicular to the conveying direction of the thermosensitive recording paper 43, as shown in FIG. 13. The thermal head 44 is driven to record one line of one color at a time on the thermosensitive recording paper 43, by applying variable heat energies from the heating elements 45 that are determined by coloring characteristics of the individual thermosensitive coloring layers as well as desirable densities or tonal levels of individual pixels designated by image data.

Since the heat energies are applied to the thermosensitive recording paper 43 while the heating elements 45 are pressed onto a surface of the thermosensitive recording paper 43, the surface of the thermosensitive recording paper 43 is thermally deformed. Especially at a print starting end 48 of an image recording area 47, that borders a blank margin 49, the temperature of the thermosensitive recording paper 43 steeply changes, so the deformation of the 10 is the largest. When the deformed portions of the thermosensitive recording paper 43 move past the conveyer roller pairs 42, conveying speed fluctuates because of the deformation of the thermosensitive recording paper 43.

As shown for instance in FIG. 14, if a convex 50 is formed at the print starting end 48 because of the thermal deformation, load on the conveyer roller pairs 42 is increased as the convex 50 moves past the conveyer roller pairs 42, so the conveying speed is lowered for that moment. As a result, the thermal head 44 applies more heat energies per unit area of the thermosensitive recording paper 43 than expected, increasing recording densities from designated levels in those lines which are recorded while the convex 50 is moving past the conveyer roller pairs 42. The lines having the increased recording densities appear as a stripe 51, as shown for example in FIG. 13. Such density unevenness, i.e. deviation from unexpected densities, always appears around a distance L1 from the print starting end 48, and the distance L1 is equal to a spacing between the thermal head 43 and the conveyer roller pairs 42.

The density unevenness or deviation provided in this way is inconspicuous if it is located in an area where a variety of colors and densities are mixed. However, the density deviation becomes so conspicuous if it appears in an area having similar colors or densities, like the sky, the sea or the facial area of a closed-up portrait, especially in an area having the same color and density, that the so-called black strip is apparent with the naked eye.

SUMMARY OF THE INVENTION

In view of the foregoing, an object of the present invention is to provide a thermal line printer and a printing method for the thermal line printer, by which the density deviation as caused by the thermal deformation of the recording paper is made less conspicuous, or reduced.

To achieve the above object in a thermal line printer having a pair of conveyer rollers for nipping and conveying a recording paper along a paper transport path, and a thermal head having an array of heating elements arranged transversely to the paper transport path and pressed onto the recording paper at a constant distance from a nipping position by the conveyer rollers, the thermal head being driven based on image data to record an image frame line by line from a print starting end of an image recording area on the recording paper as the recording paper is conveyed by the conveyer rollers in a direction advancing from the thermal head toward the conveyer rollers, the present invention suggests to provide an image analyzer for calculating a first estimation value representative of conspicuousness of potential density deviation the image frame could have in a first zone including a line that is to be recorded at the constant distance from the print starting end if the image frame is recorded from a top side thereof, and a second estimation value representative of conspicuousness of potential density deviation the image frame could have in a second zone including a line that is to be recorded at the constant distance from the print starting end if the image frame is recorded from a bottom side thereof. The image analyzer calculates the first and second estimation values based on image data of the first and second zones of the image frame respectively. Then, a control device compares the first and second estimation values to each other and controls the thermal head to start recording the image frame either from the top side or from the bottom side depending upon the estimation values such that the potential density deviation becomes less conspicuous.

The estimation values are preferably calculated based on histograms each showing the numbers of pixels contained in each of the zones in relation to tonal levels of the image data, and correction coefficients for correcting the histograms to make the estimation values the larger the more the potential density deviation becomes conspicuous. The numbers of pixels shown in relation to the tonal levels may be called pixel frequencies, and correction coefficients may be called weighting coefficient.

Where the recording paper is a color thermosensitive recording paper having at least three coloring layers for yellow, magenta and cyan, each of the estimation values is calculated by obtaining a density histogram for each color, correcting the histogram with a first kind of correction coefficients determined for each color and with a second kind of correction coefficients that weight the number of those pixels included in a middle density range more than other density ranges, and adding up the histograms for the three colors.

It is preferable to calculate a third estimation value representative of conspicuousness of potential density deviation that the image frame could have in a third zone including a line that is to be recorded at the constant distance from the print starting end if the image frame is recorded from a right side thereof, based on image data of the third zone, and a fourth estimation value representative of conspicuousness of potential density deviation that the image frame could have in a fourth zone including a line that is to be recorded at the constant distance from the print starting end if the image frame is recorded from a left side thereof, based on image data of the fourth zone. The first to fourth estimation values are compared to one another, to decide to start recording the image frame from one of the four sides which corresponds to the smallest estimation value.

According to another aspect of the present invention, a printing method for a thermal line printer wherein an array of heating elements of a thermal head are pressed onto a recording paper and driven in accordance with image data to record an image frame in an image recording area on the recording paper line by line from a print starting end of the image recording area, as the recording paper is conveyed by a pair of conveyer rollers in a direction advancing from the thermal head toward the conveyer roller pair, the conveyer rollers nipping the recording paper at a constant distance from the pressing position of the heating element array, comprises the steps of: picking up image data of a first line that is to be recorded at the print starting end; calculating based on tonal levels of the picked up image data an amount of heat energy applied from the thermal head to the recording paper at the print starting end; deriving from the heat energy amount a deformation amount of the recording paper; calculating based on the deformation amount a density correction value; and correcting recording densities of a line located at the constant distance from the print starting end, in accordance with the density correction value.

Because a plurality of lines located around the constant distance from the print starting end several lines can suffer the density deviation, it is preferable to obtain a first density correction value from image data of the first and following several lines, and correct recording densities of the plurality of lines around the constant distance, in accordance with correction values that are determined for the respective lines based the first density correction value.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE EMBODIMENTS

Figure 1:
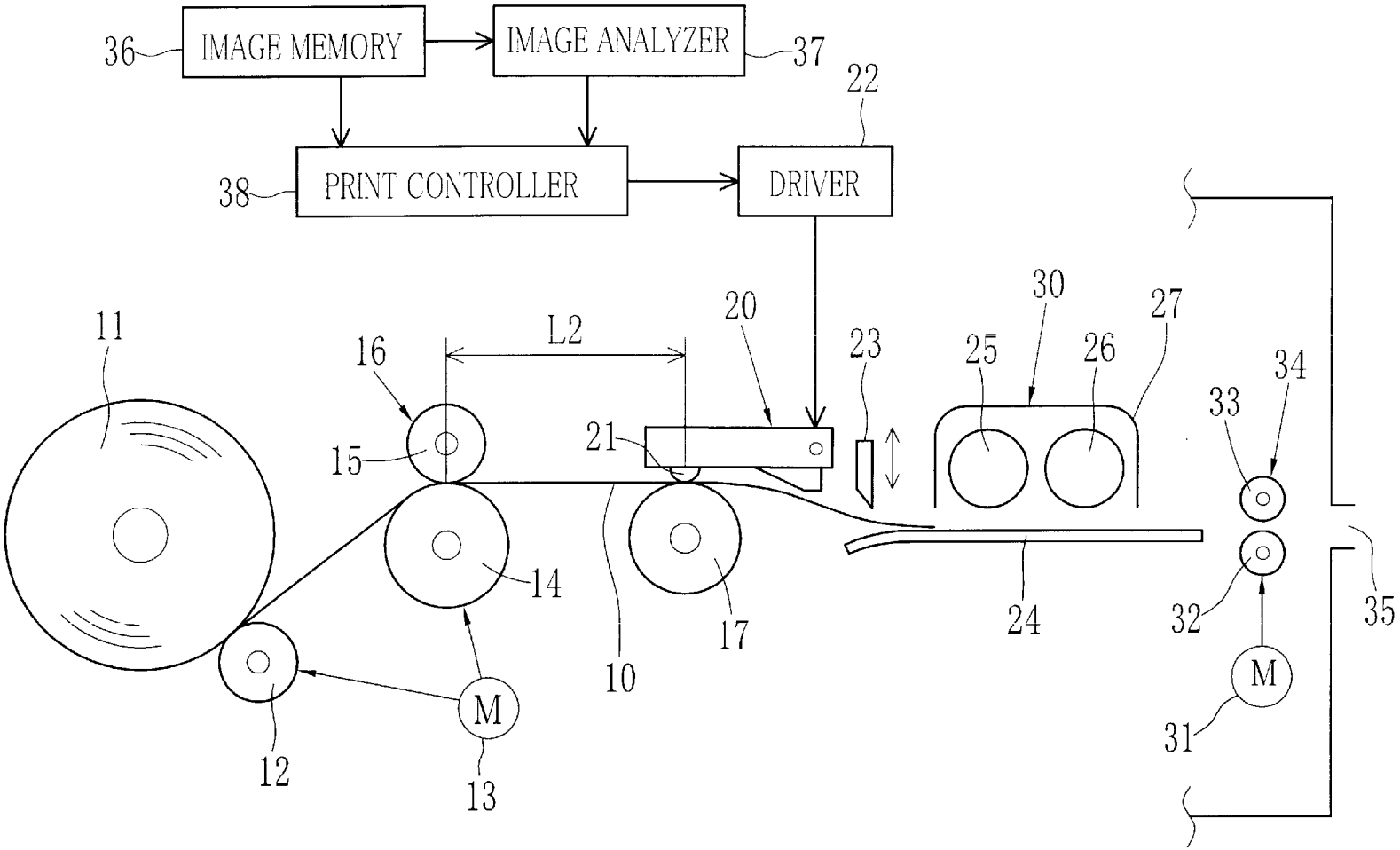
FIG. 1 is a schematic diagram illustrating a color thermosensitive line printer according to an embodiment of the present invention.

In a thermosensitive color printer shown in FIG. 1, a thermosensitive color recording paper 10 is loaded in a printer housing in the form of a paper roll 11. The thermosensitive color recording paper 10 has a conventional layered structure consisting of three thermosensitive coloring layers for cyan, magenta and yellow and a transparent protective layer formed atop another on a base material. The topmost or outermost yellow coloring layer has the highest thermal sensitivity, and the bottommost or innermost cyan coloring layer has the lowest thermal sensitivity. Accordingly, the yellow coloring layer needs the smallest heat energy for developing color, and the cyan coloring layer needs the largest heat energy for developing color. The magenta coloring layer has a property of being fixed by ultraviolet rays of 365 nm, whereas the yellow coloring layer has a property of being fixed by near-ultraviolet rays of 420 nm.

A paper supply roller 12 is set in contact with an outer periphery of the paper roll 11. The paper supply roller 12 is driven by a feed motor 13. When the paper supply roller 12 is rotated in a clockwise direction in the drawings, the paper roll 11 rotates counterclockwise, feeding out the thermosensitive color recording paper 10. When the paper supply roller 12 is rotated counterclockwise, the thermosensitive color recording paper 10 is wound back onto the paper roll 11.

A conveyer roller paper 16 is placed behind the paper supply roller 12. The conveyer roller pair 16 consists of a capstan roller 14 and a nip roller 15. The capstan roller 14 is rotated by the feed motor 13 in opposite directions, to convey the thermosensitive color recording paper 10 in a forward or paper supply direction and a backward direction. The nip roller 15 is movable between a nipping position to nip the thermosensitive color recording paper 10 by the nip roller 15 and the capstan roller 14, and a position away from the capstan roller 14. The nip roller 15 rotates following the movement of the conveyed thermosensitive color recording paper 10. While an image is recorded on the thermosensitive color recording paper 10, a print controller 38 supplies motor drive pulses at constant intervals to the feed motor 13 to rotate the capstan roller 14 continuously.

A platen roller 17 for supporting the thermosensitive color recording paper 10 from the bottom and a thermal head 20 are placed behind the conveyer roller pair 16 in the paper supply direction. The thermal head 20 may pivot on an axis and has a heating element array 21 on its distal end portion, so the thermal head 20 moves between a recording position to press the heating element array 21 onto the thermosensitive color recording paper 10, and a retracted position to set back the heating element array 21 away from the platen roller 17. The heating element array 21 is pressed onto the thermosensitive color recording paper 10 at a distance L2 from the nipping position of the conveyer roller pair 16.

The thermal head 20 is driven by a driver 22 to heat up heating elements of the heating element array 21 in accordance with print data, for applying necessary heat energies to the thermosensitive color recording paper 10 for thermal recording. The heat energy for one color pixel is a sum of a bias heat energy determined by each coloring layer and a gradation heat energy determined by a tonal level or a recording density of the color pixel, on the basis of a coloring characteristic curve of each coloring layer.

A cutter 23 is placed behind the thermal head 20 in the paper supply direction, for cutting the thermosensitive color recording paper 10 into a designated size after having a full-color image recorded thereon.

A guide plate 24 is provided behind the cutter 23 in the paper supply direction, for guiding the thermosensitive color recording paper 10 along a paper transport path as it is conveyed back and forth by the conveyer roller pair 16. Above the guide plate 24 is disposed an optical fixing device 30 that consists of a yellow fixing lamp 25, a magenta fixing lamp 26 and a reflector 27. The yellow fixing lamp 25 emits ultraviolet or near-ultraviolet rays having an emission peak at a wavelength range of 420 nm, and the magenta fixing lamp 26 emits ultraviolet rays having an emission peak at a wavelength range of 365 nm. The reflector 27 is provided with a reflective layer on its inside surface so that the reflector 27 reflects the rays from the lamp 25 or 26 toward the thermosensitive color recording paper 10.

A capstan roller 32 driven by an ejection motor 31 and a pinch roller 33 are placed behind the optical fixing device 30. The rollers 32 and 33 constitute an ejection roller pair 34 that nips and feeds the thermosensitive color recording paper 10 out of the printer housing though an exit 35, after the thermosensitive color recording paper 10 is cut by the cutter 23.

The image to print is read as an image signal in the printer from an external apparatus, such as computer, a video camera and a scanner, or from an image recording medium, including a magnetic recording medium, an electronic recording medium, and an optical recording medium. The image signal is written on an image memory 36 in the form of digital image data for yellow, magenta and cyan. The image data of each color represents a tonal level of one pixel by 8 bit, wherein the higher numerical value represents the higher recording density.

Figure 2:
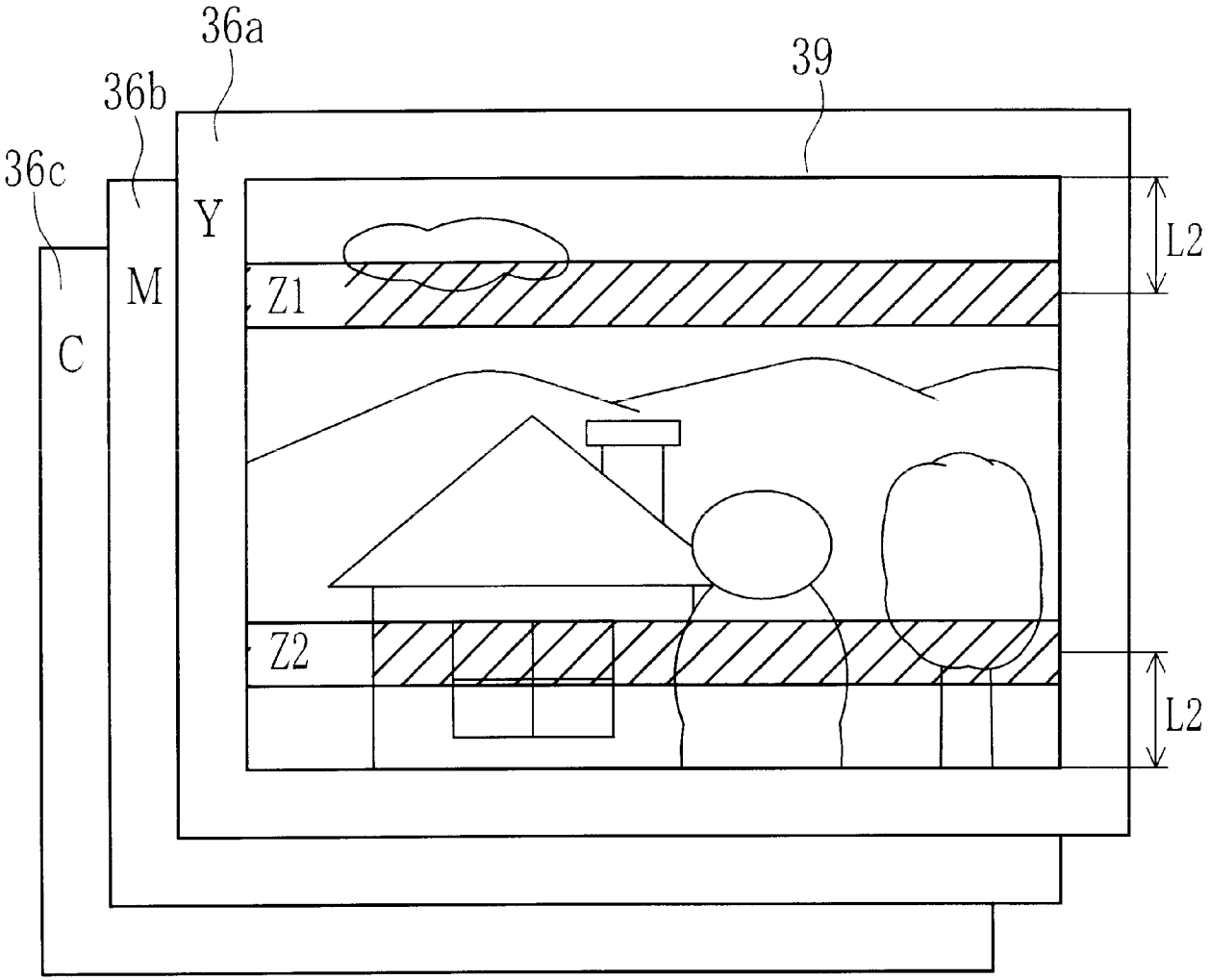
FIG. 2 is an explanatory diagram illustrating upper and lower zones of an image frame, for which estimation values representative of conspicuousness of density deviation are calculated.

As shown in FIG. 2, the image memory 36 consists of a yellow image memory 36*a*, a magenta image memory 36*b* and a cyan image memory 36*c*, for storing the image data for yellow, magenta and cyan frames of a full-color image frame in a three-color separated fashion. An image analyzer 37 is connected to the image memory 36, for calculating estimation values from the image data. The estimation values represent the degree of conspicuousness of the unexpected density variation that would be caused by fluctuations in conveying speed of the thermosensitive color recording paper 10 during the thermal recording, as set forth above in the description of the background art. Based on the estimation values, the print controller 38 decides the direction of printing an image, as set forth in detail below. After deciding the image printing direction, the print controller 38 transfers the image data one line after another from the image memory 36 to the driver 22. The driver 22 converts the image data of one line into the print data for controlling electric powers conducted through the heating elements.

Now, the operations of the image analyzer 37 and the print controller 38 will be described with reference to FIGS. 2 to 6.

The image analyzer 37 picks up the image data of those pixels which are included in an upper zone and a lower zone of an image frame. As illustrated in FIG. 2, premising that a top end 39 of an image frame corresponds to an end of an image recording area on the thermosensitive color recording paper 10 in the paper conveying direction, the upper and lower zones Z1 and Z2 extend in a widthwise direction of the thermosensitive color recording paper 10 across the image recording area, and have a constant length in the conveying direction of the thermosensitive color recording paper 10. The upper zone Z1 is centered on a line located at the distance L2 from the top end 39, whereas the lower zone Z2 is centered on a line located at the distance L2 from a bottom end of the image frame. As shown in FIG. 1, L2 is the distance between the nipping position of the conveyer roller pair 16 and the pressing position of the heating element array 21 onto the thermosensitive color recording paper 10.

In the example of image frame shown in FIG. 2, the upper zone Z1 is composed mostly of monotonic objects, like the sky and clouds, so the density deviation would be conspicuous in this zone. On the contrary, there are various objects, including a person, a tree and a house, in the lower zone Z2. Therefore, the density deviation would affect less in the lower zone Z2 in this instance. That is, the conspicuousness of the undesirable density deviation depends upon the objects contained in the image zone suffering the density deviation.

Figure 3:
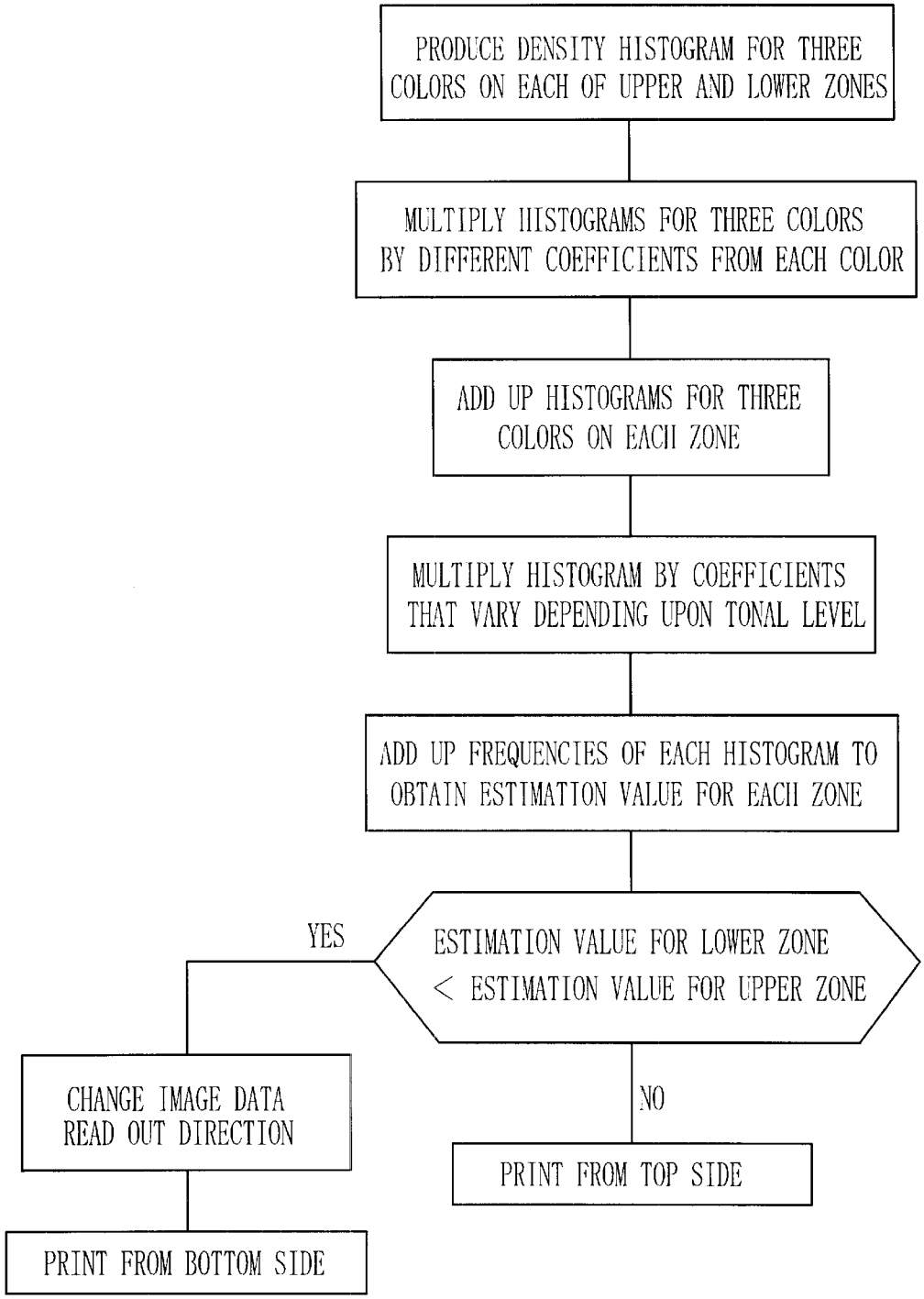
FIG. 3 is a flow chart illustrating a sequence of calculating the estimation values and deciding a direction to print the image frame.
Figure 4A:
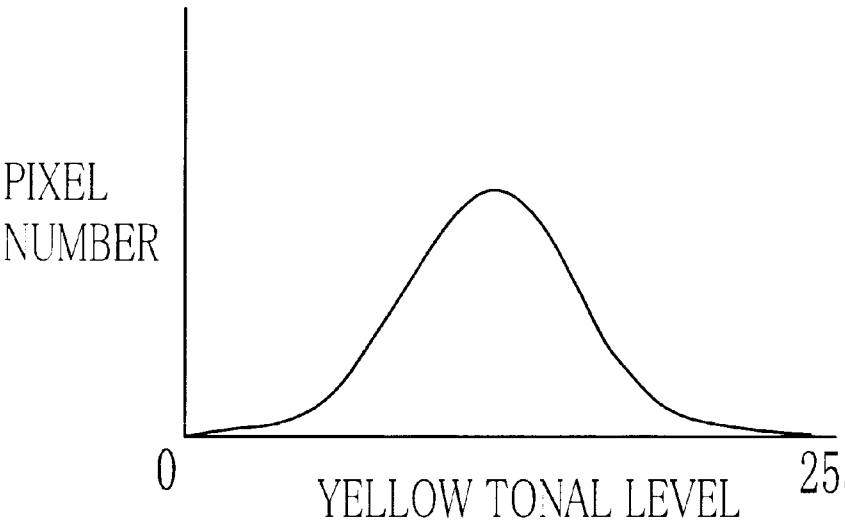
FIGS. 4A and 4B are histograms showing the number of yellow pixels included in the upper and lower zones in relation to tonal levels of the pxiels respectively.
Figure 4B:
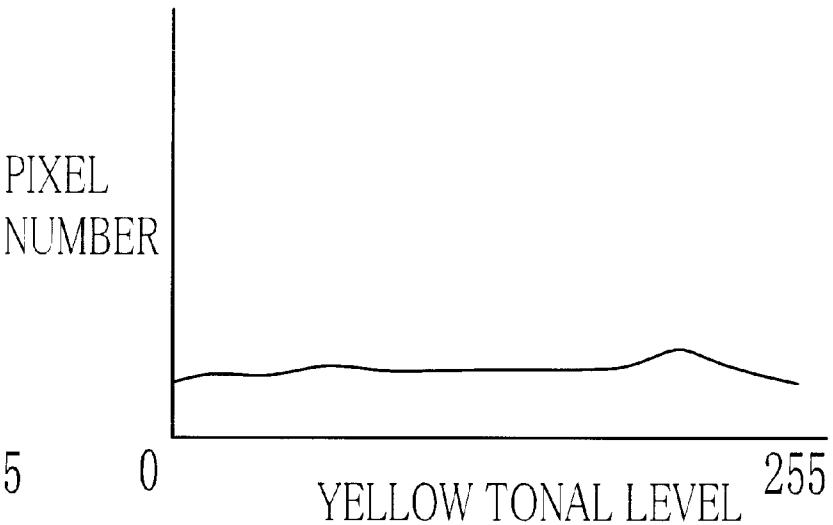

From the picked-up image data, the image analyzer 37 produces histograms as shown for example in FIGS. 4A and 4B, showing the numbers of pixels at the respective tonal levels in the upper zone Z1 and in the lower zone Z2 respectively. As mentioned in the flow chart of FIG. 3, such histograms are produced for the three colors in the upper and lower zones, though the histograms for yellow alone are shown in the drawings. Thereafter, each histogram is multiplied by a first kind of correction coefficient whose value varies depending upon the color. Since the density deviation looks most conspicuous in the magenta pixels, and least conspicuous in the yellow pixels, the first correction coefficient has the highest value for magenta, and the lowest value for yellow.

Figure 5:
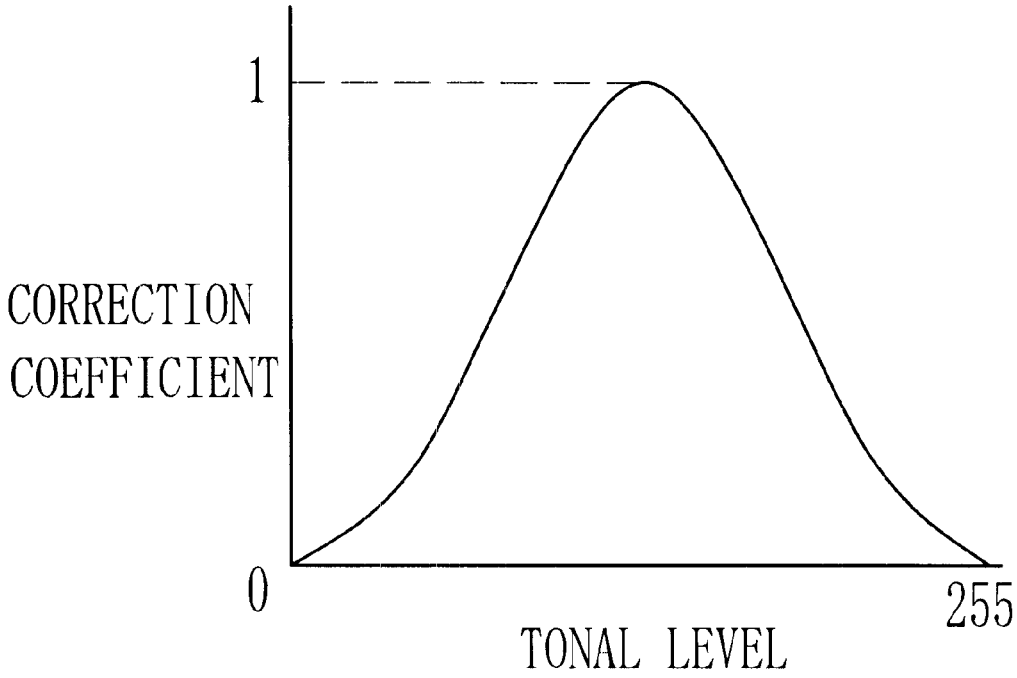
FIG. 5 is a graph illustrating correction coefficients by which the pixels numbers are multiplied to correct the histograms depending upon tonal levels.
Figure 6A:
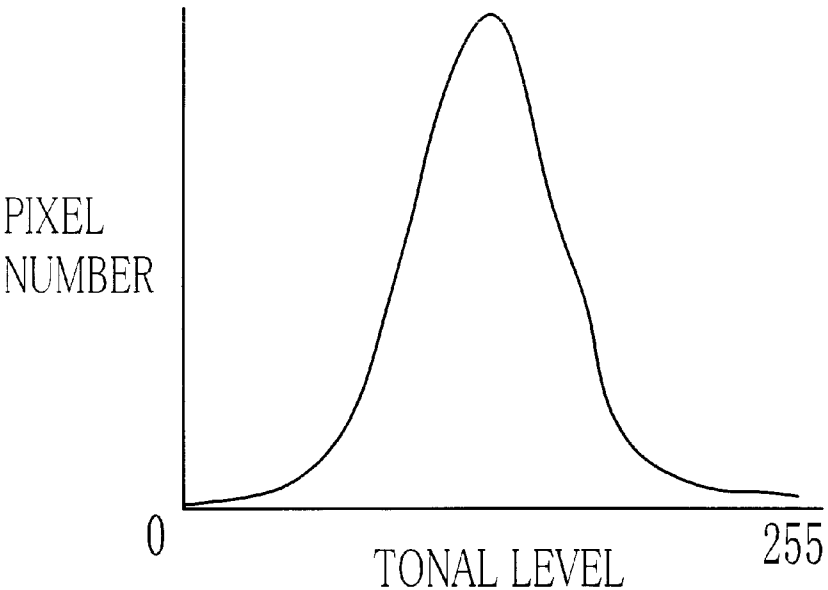
FIGS. 6A and 6B are histograms obtained as the sum of three histograms for three colors on each of the upper and lower zones.
Figure 6B:
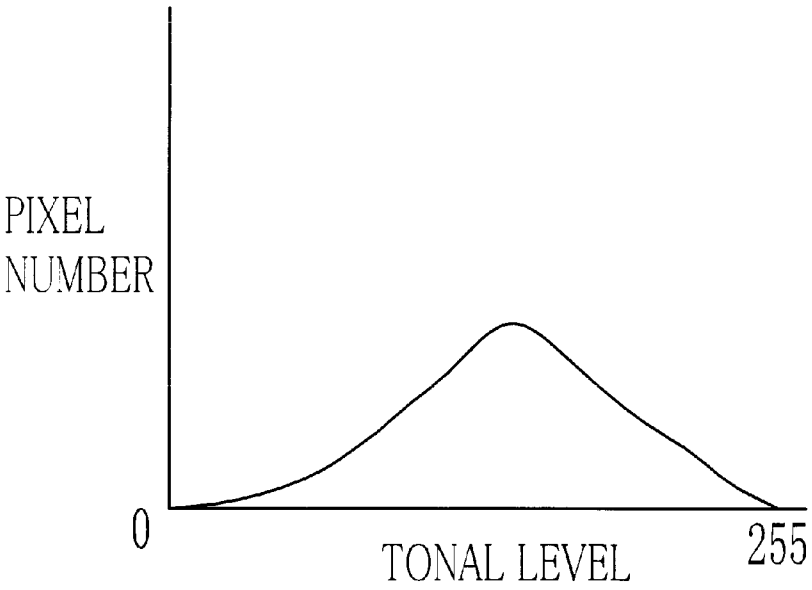
Figure 7:
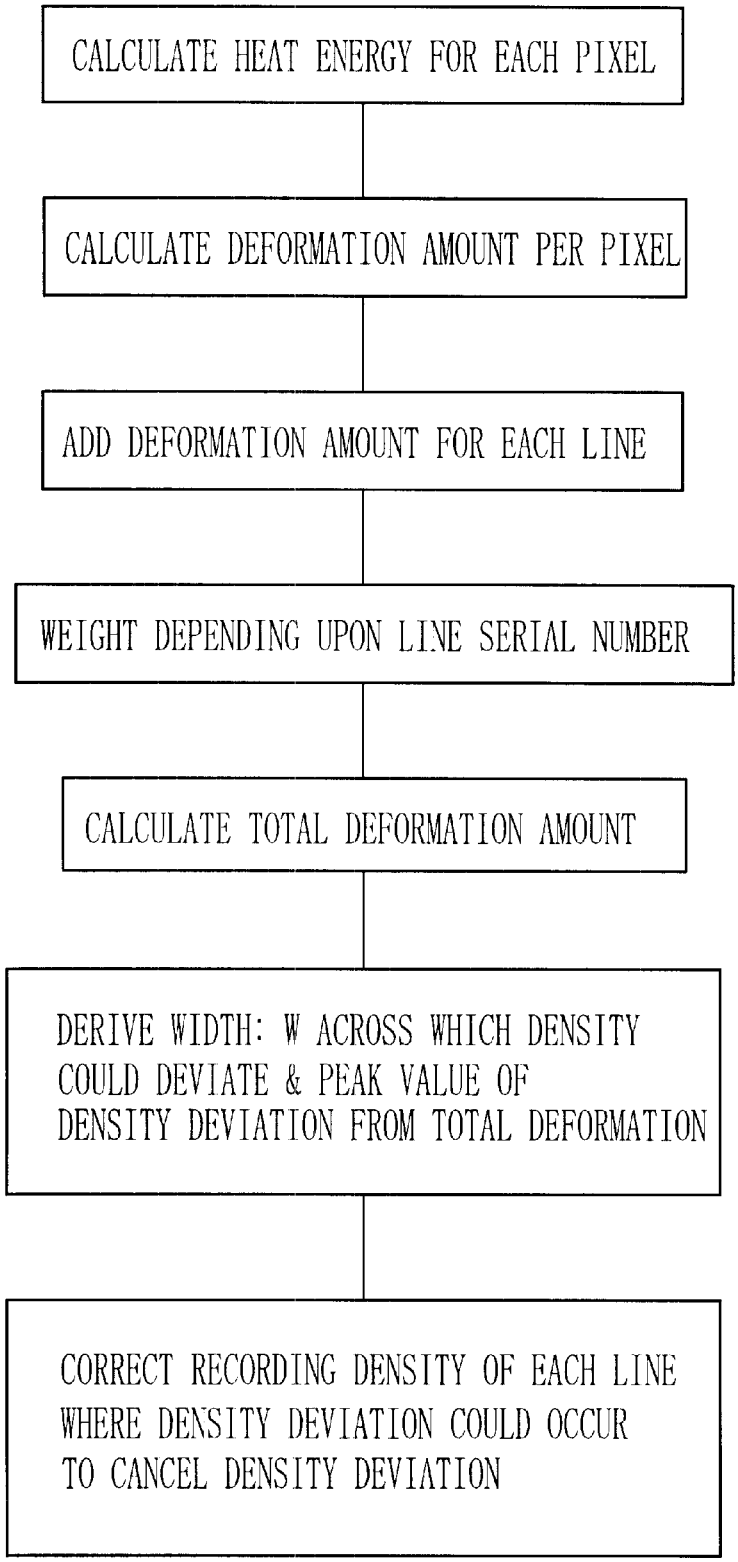
FIG. 7 is a flow chart illustrating a sequence of correcting recording densities to reduce density deviation on the basis of an estimated amount of deformation of the thermosensitive recording paper.

After corrected by the first correction coefficients, the histograms for the three colors of each zone are added up. Thereafter, the added-up histogram of each zone is multiplied by second kind of correction coefficients having the highest value for the middle tonal level, as is shown in FIG. 5. This is because the density deviation becomes less conspicuous the naked eye in those portions having very high or low densities. Next, the numbers or frequencies of pixels are added up for each zone, and the sums are served as the estimation values for the density deviation.

Because of the first and second correction coefficients, the estimation value becomes the higher, the more magenta pixels and the more middle density pixels are included in the upper or lower zone. The estimation values for the upper and lower zones Z1 and Z2 are sent from the image analyzer 37 to the print controller 38. Then the print controller 38 decides the image printing direction depending upon which of the estimation values is smaller than the other. That is, the print controller 38 starts printing the image from the top end 39 when the estimation value for the upper zone Z1 is smaller, or from the bottom end of the image frame when the estimation value for the lower zone Z2 is smaller. In the instance shown in FIG. 2, the estimation value for the lower zone Z2 comes up to be the smaller one, so the print controller 38 starts reading out the image data from the image memory 36 in the sequence from the bottom side to the top side of the image frame.

Now the operation of the thermosensitive color printer of the present embodiment will be described.

When a print starting operation is done, the paper supply roller 12 is rotated by the feed motor 13 to feed out the thermosensitive color recording paper 10 from the paper roll 11. When a not-shown sensor detects that a leading edge of the thermosensitive color recording paper 10 moves past the conveyer roller pair 16, the conveyer roller pair 16 nips the thermosensitive color recording paper 10, and the capstan roller 14 is rotated by the feed motor 13 in the forward direction to feed the thermosensitive color recording paper 10 to the thermal head 20. Simultaneously, the print controller 38 starts calculating the conveyed amount of the thermosensitive color recording paper 10 from the number of drive pulses applied to the feed motor 13.

While the thermosensitive color recording paper 10 is being fed out from the paper roll 11, the image analyzer 37 reads out the image data of the upper and lower zones Z1 and Z2 from the image memory 36, and calculates the estimation values for the density deviation that might occur in both zones Z1 and Z2, according to the sequence shown in FIG. 3. The estimation values are compared to each other in the print controller 38. Then, the print controller 38 decides to read out the image data either from the top side of the image frame or from the bottom side thereof if the estimation value for the upper zone Z1 or the estimation value for the lower zone Z2 is smaller than the other value respectively.

The thermosensitive color recording paper 10 is conveyed in the paper supply direction to move past the platen roller 17. When the conveyed amount of the thermosensitive color recording paper 10 reaches a predetermined value, the feed motor 13 stops, and the thermal head 20 is shifted to the recording position. Thereafter, the capstan roller 14 is rotated reversely to convey the thermosensitive color recording paper 10 in the backward direction.

When a print starting end of the image recording area of the thermosensitive color recording paper 10, i.e. a trailing end in the paper supply direction in this embodiment, is located under the heating element array 21, the print controller 38 starts thermal printing by transferring the image data line-sequentially from the image memory 36 to the driver 22. The driver 22 produces the printer data from the image data, and sends the print data to the heating element array 21, to control ON-OFF of the heating elements each individually. Because the heat energy necessary for recording yellow is the lowest among the three colors, the yellow frame is printed first, so the image data is read out first from the yellow image memory 36*a*.

Since the thermal head 20 begins to apply the heat energy to the thermosensitive color recording paper 10 at the print starting end of the image recording area while pressing the heating element array 21 onto the thermosensitive color recording paper 10, the thermosensitive color recording paper 10 is deformed at the print starting end. When the deformed portion of the thermosensitive color recording paper 10 passes through the conveyer roller pair 16, the paper conveying speed is lowered because of an increase in load on the conveyer roller pair 16. As a result, the intervals between the lines of the recorded image are shortened in that zone of the image recording area that is located at around the distance L2 from the deformed end, so the average recording density of that zone becomes higher than expected. However, since the image printing direction is decided so that the zone located around the distance L2 from the deformed end contains such objects that the density deviation would be less conspicuous, the density deviation affects the image quality less than the case where the image is printed from the opposite end of the image frame.

When the thermal recording of the yellow frame is finished, the feed motor 13 stops and the thermal head 20 is shifted to the retracted position. Thereafter, the capstan roller 14 is rotated forward to convey the thermosensitive color recording paper 10 in the paper supply direction and, at the same time, the yellow fixing lamp 25 is turned on. While the thermosensitive color recording paper 10 is being conveyed in the paper supply direction under the optical fixing device 30, the recorded yellow frame is fixed by the near-ultraviolet rays from the yellow fixing lamp 25.

When the thermosensitive color recording paper 10 is conveyed by such an amount that the entire image recording area is uniformly exposed to the near-ultraviolet rays, the feed motor 13 stops, and the yellow fixing lamp 25 is turned off. Then, the thermal head 20 is shifted to the recording position to nip the thermosensitive color recording paper 10. Thereafter, the capstan roller 14 starts being rotated reversely to convey the thermosensitive color recording paper 10 in the backward direction. When the print starting end of the image recording area is located under the heating element array 21, the thermal head 20 starts being driven through the driver 21 to record the magenta frame from the same line as for the yellow frame, in the same way as described with respect to the yellow frame.

When the thermal recording of the magenta frame is finished, the thermal head 20 is shifted to the retracted position, and the thermosensitive color recording paper 10 starts being conveyed in the paper supply direction. At the same time, the magenta fixing lamp 26 is turned on to fix the magenta frame optically. When the optical fixing of the magenta frame is finished, the magenta fixing lamp 26 is turned off, and the thermosensitive color recording paper 10 starts being conveyed in the backward direction for the third time. When the print starting end of the image recording area reaches the heating element array 21, the thermal head 20 starts being driven to record the cyan frame line by line.

When the thermal recording of the cyan frame is finished, the thermal head 20 is shifted to the retracted position, and the thermosensitive color recording paper 10 starts being conveyed in the paper supply direction toward the ejection roller pair 34. Since the cyan coloring layer has such a low thermal sensitivity that it would not color under normal preservative conditions, the cyan coloring layer does not have the property of being optically fixed. So the optical fixing device 30 is not turned on after the cyan frame recording. But it is possible to turn on the magenta fixing lamp 26 while the thermosensitive color recording paper 10 is being conveyed toward the ejection roller pair 34, for the sake of bleaching the blank portions of the thermosensitive color recording paper 10.

When it is determined based on the number of drive pulses to the feed motor 13 that the leading edge of the thermosensitive color recording paper 10 moves by a designated amount past the ejection roller pair 34, the ejection roller pair 34 nips the thermosensitive color recording paper 10, and the cutter 23 is activated to cut the thermosensitive color recording paper 10 into a designated length. Thereafter, the ejection motor 31 is driven to rotate the capstan roller 32 to eject the cut piece of the thermosensitive color recording paper 10 through the exit 35.

As described so far, conspicuousness of the potential density deviation or unevenness is estimated with respect to the two zones Z1 and Z2 located around the distance L2 from the top and bottom ends of the image frame, wherein L2 is equal to the distance between the nipping position of the conveyer roller pair 16 and the pressing position of the heating element array 21 onto the thermosensitive color recording paper 10. However, it is possible to estimate conspicuousness of the potential density unevenness with respect to those zones which are located around the distance L2 from left and right ends of the image frame, in addition to the above two zones Z1 and Z2, and start printing from one of these four ends that is determined by the smallest estimation value such that the density unevenness would become least conspicuous.

In some cases, it can be undesirable recording the images in different directions from each other. Therefore, it is preferable to provide the printer with a device to permit the operator turning off the image analyzer 37.

Although the estimation for conspicuousness of the potential density unevenness is done based on the density histograms of yellow, magenta and cyan frames, it is possible to use density histograms of black in addition to these three colors, or density histograms of red, green and blue.

The method of calculating the estimation values is not to be limited to the above embodiment, but may be modified appropriately. For example, where the background color is designated, like ID portraits, using such correction coefficients is preferable that add the heaviest weight on estimation values for the background color.

Although the density unevenness is made less conspicuous by changing the image printing direction in the above embodiment, it is possible to correct the image data to reduce or cancel the density unevenness on the basis of estimation values for the density unevenness, for example in the way as described with respect to a second embodiment below that is illustrated in FIGS. 7 to 11, wherein equivalent elements are designated by the same reference numbers as for the first embodiment, so the details of these elements are omitted in the following description.

Before the thermal head 20 starts recording the yellow frame, an image analyzer 37 reads out yellow image data of the first line to record, from the yellow image memory 36*a*. The image analyzer 37 then calculates amounts of heat energies generated from the individual heating elements on the basis of the yellow image data for the respective heating elements and data on temperature of the thermal head 20 that is detected in an appropriate way.

Figure 8:
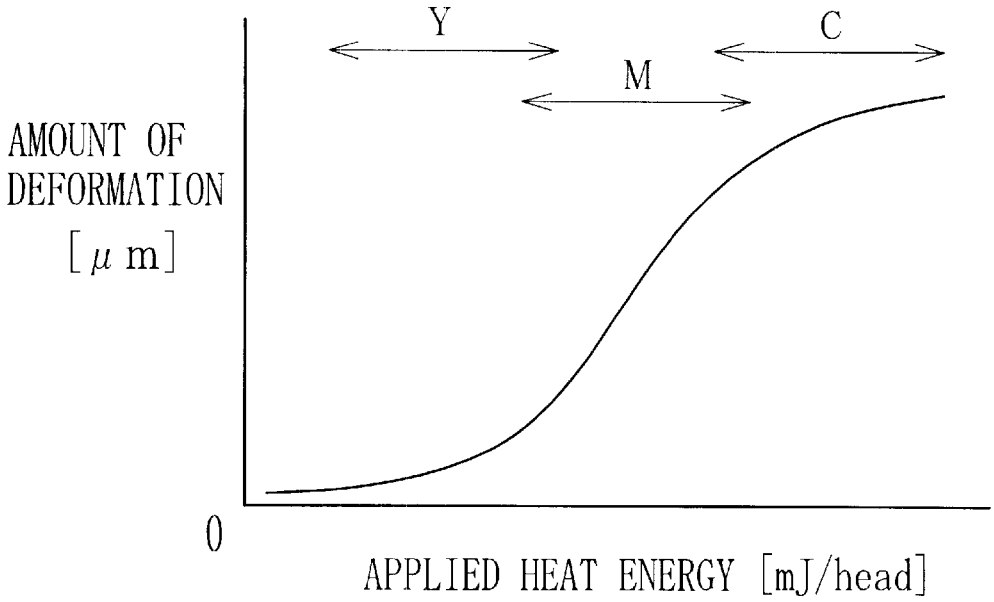
FIG. 8 is a graph illustrating a relationship between heat energies applied to the thermosensitive recording paper and deformation amounts thereof.

The image analyzer 37 previously stores correlation data that shows a correlation between the amount of heat energy and the amount of deformation of the thermosensitive color recording paper 10, as shown in FIG. 8, the correlation being experimentally determined. By means of the correlation data, the image analyzer 37 converts the calculated heat energy amount into a deformation amount of the thermosensitive color recording paper 10 for each individual heating element. The deformation amounts of all the heating elements are added up to be a deformation amount on the first line.

Figure 9:
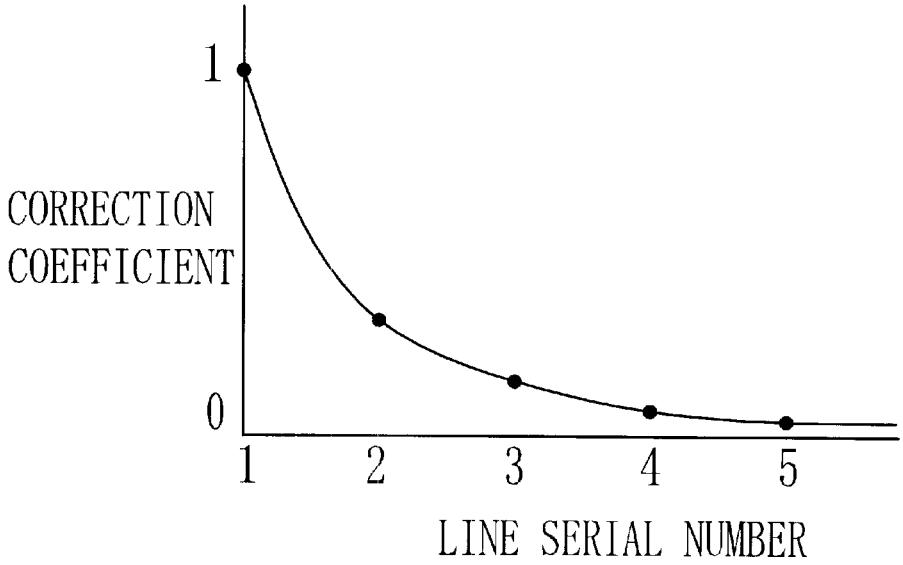
FIG. 9 is a graph illustrating correction coefficients allocated to the first to fifth lines in the order of recording them.

As known in the art, where the heating elements are relatively long or their glazed layers have a relatively large diameter, the thermosensitive color recording paper 10 is deformed across several lines from the first line. In that case, it is preferable to calculate the amounts of deformation for the first and following several lines, e.g. from the first to fifth lines, and correct the respective deformation amounts with correction coefficients as shown in FIG. 9. That is, the larger correction coefficient is used for the deformation amount of the closer line to the print starting end, because the thermosensitive color recording paper 10 is actually deformed the larger, the closer to the print starting end. Thereafter, the corrected deformation amounts of all of these lines are summed up to be a total deformation amount.

Figure 10:
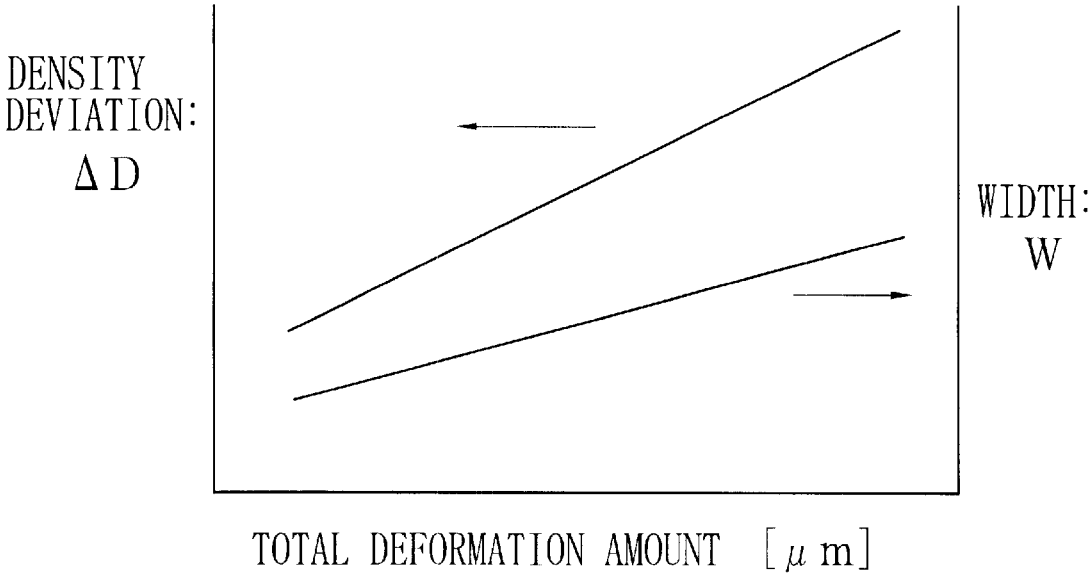
FIG. 10 is a graph illustrating the amounts of density deviation and the width W across which the density deviation could occur on the thermosensitive recording paper, in relation to total deformation amounts.

The image analyzer 37 also stores a conversion table as shown in FIG. 10, that is determined experimentally. Through this conversion table, a width W across which density deviation could occur and an amount of density deviation $\Delta D$ are derived from the total deformation amount. Provided that P represents the line pitch of the recorded image, the number of lines where the density deviation could occur is defined to be W/P.

Figure 11:
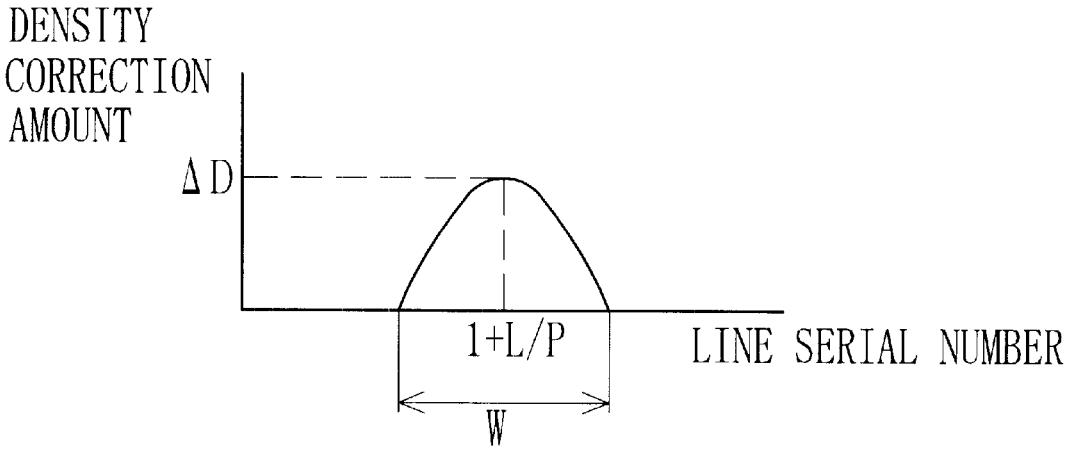
FIG. 11 is a graph illustrating density correction values for a plurality of lines included in a zone determined by the width W and a distance L between a heating element array and a pair of conveyer rollers.
Figure 12:
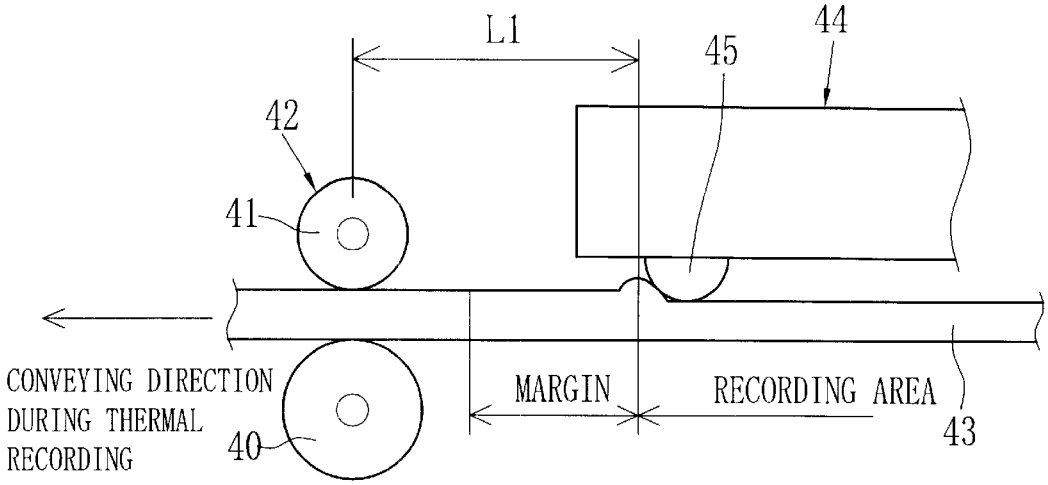
FIG.12 PRIOR ART
FIG. 12 is an explanatory diagram illustrating a situation of deforming the thermosensitive recording paper by the heating element at the print starting end.
Figure 14:
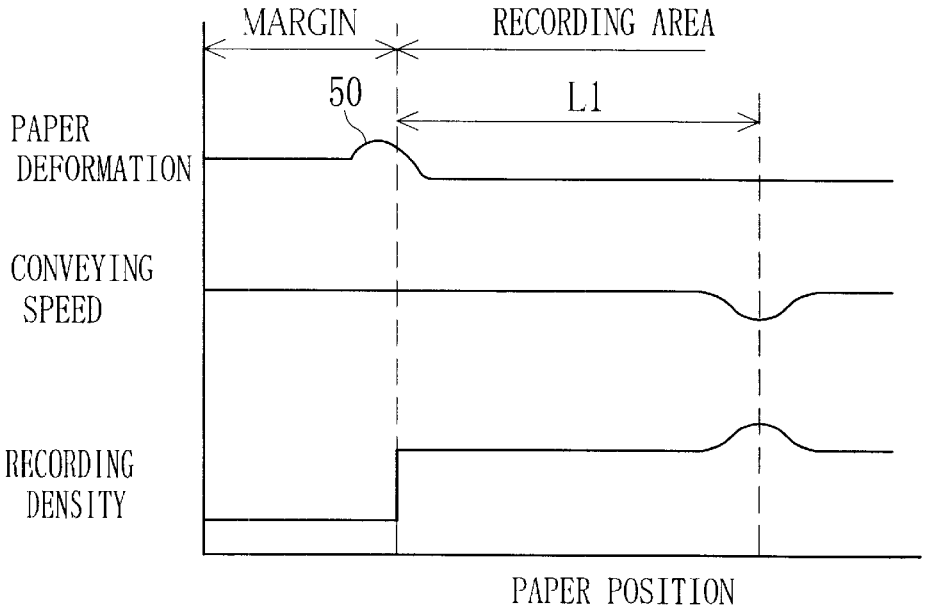
FIG.14 PRIOR ART
FIG. 14 is a graph illustrating a relationship between the deformation amount and conveying speed of the thermosensitive recording paper, and recording density.
Figure 13:
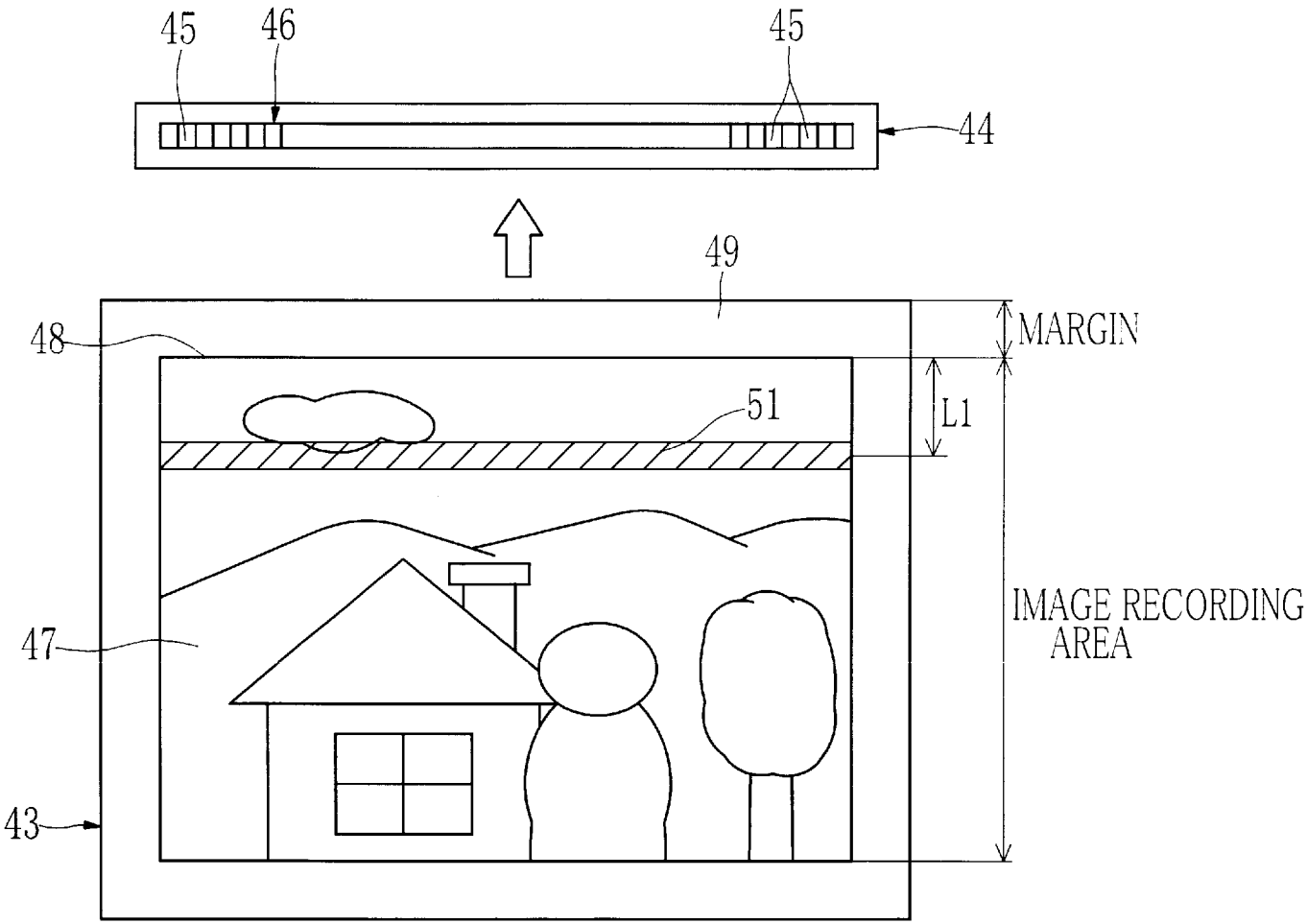
FIG. 13 PRIOR ART
FIG. 13 is an explanatory diagram illustrating an example of an image having a stripe of density deviation caused by the deformation at the print starting end.

Among these W/P lines, a middle line could have the density deviation of the amount $\Delta D$, the middle line being a line located at a distance L from the first line, wherein L represents a distance of the middle line from the first line, that is equal to the distance from a pressing position of the heating element array onto the thermosensitive color recording paper 10 to a nip position by a conveyer roller pair. Therefore, the middle line may be given as the (1+L/P) line in the sequence of recording from the first line. Accordingly, yellow image data for the (1+L/P) line or print data for driving the heating elements to record the (1+L/P) line is corrected to lessen the coloring density of each pixel of this line by the amount $\Delta D$. As shown in FIG. 11, yellow image data or print data for other lines located before and behind the middle line are corrected by density correction values that decreases from the amount $\Delta D$ with the distance from the middle line along a sine curve.

Magenta image data or print data for the magenta frame is also corrected on the basis of an amount of density deviation $\Delta D$ for magenta and a width W across which the density unevenness could occur in the magenta frame, these values being obtained in the same way as for the yellow frame. It is desirable to take account of the amounts of deformation that would be caused by the yellow thermal recording, on calculating the density deviation amount $\Delta D$ and the width W for the magenta frame. Also cyan image data or print data for the cyan frame is corrected in the same way as for other colors.

Although the present invention has been described so far with respect to the preferred embodiments applied to the thermosensitive line printers, the present invention is applicable to other types of thermal printers, such as thermal transfer type printers. Thus, the present invention is not to be limited to the above embodiment but, on the contrary, various modification will be possible to those skilled in the art without departing from the scope of appended claims.

What is claimed is:

1. A thermal line printer comprising:

a pair of conveyer rollers for nipping and conveying a recording paper along a paper transport path;

a thermal head having an array of heating elements arranged transversely to said paper transport path and pressed onto said recording paper at a constant distance from a nipping position by said conveyer rollers, said thermal head being driven based on image data to record an image frame line by line from a print starting end of an image recording area on said recording paper as said recording paper is conveyed by said conveyer rollers in a direction advancing from said thermal head toward said conveyer rollers;

an image analyzer for calculating based on said image data, a first estimation value representative of conspicuousness of potential density deviation said image frame could have in a first zone including a line that is to be recorded at said constant distance from said print starting end if said image frame is recorded from a top side thereof, and a second estimation value representative of conspicuousness of potential density deviation that said image frame could have in a second zone including a line that is to be recorded at said constant distance from said print starting end if said image frame is recorded from a bottom side thereof; and a control device for comparing said first and second estimation values to each other and controlling said thermal head to start recording said image frame either from said top side or from said bottom side depending upon said estimation values such that said potential density deviation becomes less conspicuous.

2. A thermal line printer as recited in claim 1, wherein said image analyzer further calculates based on said image data a third estimation value representative of conspicuousness of potential density deviation said image frame could have in a third zone including a line that is to be recorded at said constant distance from said print starting end if said image frame is recorded from a right side thereof, and a fourth estimation value representative of conspicuousness of potential density deviation said image frame could have in a fourth zone including a line that is to be recorded at said constant distance from said print starting end if said image frame is recorded from a left side thereof, and wherein said control device compares said four estimation values to decide to start recording said image frame from one of said four sides which corresponds to the smallest estimation value.

3. A printing method for a thermal line printer wherein an array of heating elements of a thermal head are pressed onto a recording paper and driven in accordance with image data to record an image frame in an image recording area on said recording paper line by line from a print starting end of said image recording area, as said recording paper is conveyed by a pair of conveyer rollers in a direction advancing from said thermal head toward said conveyer roller pair, said conveyer rollers nipping said recording paper at a constant distance from the pressing position of said heating element array, said printing method comprising the steps of:

calculating a first estimation value representative of conspicuousness of potential density deviation said image frame could have in a first zone including a line that is to be recorded at said constant distance from said print starting end of said image recording area if said image frame is recorded from a top side thereof, based on image data of said first zone;

calculating a second estimation value representative of conspicuousness of potential density deviation said image frame could have in a second zone including a line that is to be recorded at said constant distance from said print starting end if said image frame is recorded from a bottom side thereof, based on image data of said second zone;

comparing said first and second estimation values to each other; and controlling said thermal head to start recording said image frame either from said top side when said first estimation value is smaller or from said bottom side when said second estimation value is smaller.

4. A printing method as recited in claim 3, wherein said estimation values are calculated based on histograms showing the numbers of pixels contained in each of said zones in relation to tonal levels of said image data, and correction coefficients for correcting said histograms to make said estimation values the larger the more said potential density deviation becomes conspicuous.

5. A printing method as recited in claim 4, wherein said recording paper is a color thermosensitive recording paper having at least three coloring layers for yellow, magenta and cyan, and each of said estimation values is calculated by obtaining a density histogram for each color from image data of a corresponding one of said zones, correcting said histogram with a first kind of correction coefficients determined for each color and with a second kind of correction coefficients that weight the number of those pixels included in a middle density range more than other density ranges, and thereafter adding up the numbers of pixels of said histograms for the three colors.

6. A printing method as recited in one of claims 3 to 5, further comprising the steps of:

calculating a third estimation value representative of conspicuousness of potential density deviation said image frame could have in a third zone including a line that is to be recorded at said constant distance from said print starting end if said image frame is recorded from a right side thereof, based on image data of said third zone;

calculating a fourth estimation value representative of conspicuousness of potential density deviation said image frame could have in a fourth zone including a line that is to be recorded at said constant distance from said print starting end of said image recording area if said image frame is recorded from a left side thereof, based on image data of said fourth zone;

comparing said first to fourth estimation values to one another; and deciding to start recording said image frame from one of said four sides which corresponds to the smallest estimation value.

7. A printing method for a thermal line printer wherein an array of heating elements of a thermal head are pressed onto a recording paper and driven in accordance with image data to record an image frame in an image recording area on said recording paper line by line from a print starting end of said image recording area, as said recording paper is conveyed by a pair of conveyer rollers in a direction advancing from said thermal head toward said conveyer roller pair, said conveyer rollers nipping said recording paper at a constant distance from the pressing position of said heating element array, said printing method comprising the steps of:

picking up image data of a first line that is to be recorded at said print starting end;

calculating based on tonal levels of said picked up image data an amount of heat energy applied from said thermal head to said recording paper at said print starting end;

deriving from said heat energy amount a deformation amount of said recording paper;

calculating based on said deformation amount a density correction value; and correcting recording densities of a line located at said constant distance from said print starting end, in accordance with said density correction value.

8. A printing method as recited in claim 7, further comprising the steps of:

picking up image data of a second to N-th lines, N being a positive integer, in the order from said first line;

calculating based on tonal levels of said picked up image data an amount of heat energy applied for each of said first to N-th lines;

deriving from each of said heat energy amounts a deformation amount of said recording paper;

correcting said deformation amounts for said first to N-th lines with correction coefficients that are determined by respective distances of said lines from said print starting end;

calculating a density deviation amount based on a sum of said deformation amounts as corrected with said corrected coefficients;

correcting recording densities of a plurality of lines located around said constant distance from said print starting position, in accordance with density correction values which are different for each line and determined based on said density deviation amount.

9. A printing method as recited in claim 8, wherein a width across which density deviation could occur is derived from said sum of said deformation amounts, to determine said plurality of lines to correct by said width and said constant distance.

10. A printing method as recited in claim 7 or 8, wherein image data of said line or lines located at or around said constant distance from said print starting end is corrected with said density correction value or values.

11. A printing method as recited in claim 7 or 8, wherein print data for driving said heating elements is corrected with said density correction value or values when recording said line or lines located at or around said constant distance from said print starting end.

12. A printing method as recited in claim 7 or 8, wherein said recording paper is a color thermosensitive recording paper having at least three coloring layers for yellow, magenta and cyan, and said density correction value or values are obtained for each color.

13. A thermal line printer comprising:

a pair of conveyer rollers for nipping and conveying a recording paper along a paper transport path;

a thermal head having an array of heating elements arranged transversely to said paper transport path, said thermal head being driven based on image data to record an image frame line by line from a print starting end of an image recording area on said recording paper as said recording paper is conveyed by said conveyer rollers in a direction advancing from said thermal head toward said conveyer rollers;

an image analyzer for calculating based on said image data, a first estimation value representative of conspicuousness of potential density deviation of said image frame in a first region if said image frame is recorded from a top side thereof, and a second estimation value representative of conspicuousness of potential density deviation of said image frame in a second region if said image frame is recorded from a bottom side thereof; and a control device for comparing said first and second estimation values to each other and controlling said thermal head to start recording said image frame either from said top side or from said bottom side depending upon said estimation values such that said potential density deviation becomes less conspicuous.

14. A printing method for a thermal line printer wherein an array of heating elements of a thermal head are driven in accordance with image data to record an image frame in an image recording area on said recording paper line by line from a print starting end of said image recording area, as said recording paper is conveyed by a pair of conveyer rollers in a direction advancing from said thermal head toward said conveyer roller pair, said conveyer rollers nipping said recording paper, said printing method comprising the steps of:

calculating a first estimation value representative of conspicuousness of potential density deviation of said image frame in a first region if said image frame is recorded from a top side thereof, based on image data of the first region;

calculating a second estimation value representative of conspicuousness of potential density deviation of said image frame in a second region if said image frame is recorded from a bottom side thereof, based on image data of the second region;

comparing said first and second estimation values to each other; and controlling said thermal head to start recording said image frame either from said top side when said first estimation value is smaller or from said bottom side when said second estimation value is smaller.

* * * * *